US009766048B2

(12) United States Patent
Graswald et al.

(10) Patent No.: US 9,766,048 B2
(45) Date of Patent: Sep. 19, 2017

(54) DEVICE FOR CONTROLLABLE PRESSURE RELIEF OF A WEAPON

(71) Applicant: TDW Gesellschaft fuer verteidigungstechnische Wirksysteme mbH, Schrobenhausen (DE)

(72) Inventors: Markus Graswald, Pfaffenhofen an der Ilm (DE); Herbert Schalk, Karlskron (DE)

(73) Assignee: TDW Gesellschaft fuer verteidgungstechnische Wirksysteme mbH, Schrobenhausen (DE)

( * ) Notice: Subject to any disclaimer, the term of this patent is extended or adjusted under 35 U.S.C. 154(b) by 0 days.

(21) Appl. No.: 14/921,946

(22) Filed: Oct. 23, 2015

(65) Prior Publication Data

US 2016/0116261 A1 Apr. 28, 2016

(30) Foreign Application Priority Data

Oct. 24, 2014 (DE) ..... 10 2014 015 877

(51) Int. Cl.

| | |
|---|---|
| ***F42B 3/22*** | (2006.01) |
| ***F42B 39/14*** | (2006.01) |
| ***F42B 39/20*** | (2006.01) |
| ***F42C 19/08*** | (2006.01) |

(52) U.S. Cl.

CPC ..... *F42B 3/22* (2013.01); *F42B 39/14* (2013.01); *F42B 39/20* (2013.01); *F42C 19/0842* (2013.01)

(58) Field of Classification Search

CPC .. F42B 3/22; F42B 39/14; F42B 39/20; F42C 19/08; F42C 19/0842

USPC ..... 102/200, 473, 481

See application file for complete search history.

(56) References Cited

U.S. PATENT DOCUMENTS

| | | | | |
|---|---|---|---|---|
| 3,713,359 | A * | 1/1973 | Andrew | F42B 39/20 102/314 |
| 5,155,298 | A | 10/1992 | Koontz | |
| 5,786,544 | A * | 7/1998 | Gill | F42B 39/20 102/293 |
| 6,615,737 | B2 * | 9/2003 | Bonnel | C06B 45/00 102/202.1 |
| 7,373,885 | B2 * | 5/2008 | Skinner | F42B 39/14 102/481 |
| 8,931,415 | B2 * | 1/2015 | Volkmann | F42B 3/16 102/217 |

(Continued)

FOREIGN PATENT DOCUMENTS

| | | |
|---|---|---|
| DE | 100 08 914 C2 | 6/2003 |
| DE | 10 2009 017 160 B3 | 8/2010 |

(Continued)

OTHER PUBLICATIONS

European Search Report issued in European counterpart application No. 15 00 3034 dated Feb. 15, 2016, with Statement of Relevancy (Two (2) pages).

*Primary Examiner* — James S Bergin

(74) *Attorney, Agent, or Firm* — Crowell & Moring LLP

(57) ABSTRACT

The invention relates to a device on the ignition device of a weapon, which can be triggered, for pressure relief, before or simultaneously with the initiation of the deflagrative reaction of the explosive charge, and has at least one channel that can be opened in a controlled manner and connects the interior of the weapon with the external surroundings of the weapon.

18 Claims, 3 Drawing Sheets

(56) References Cited

U.S. PATENT DOCUMENTS

| | | | |
|---|---|---|---|
| 2003/0010246 | A1 | 1/2003 | Bonnel et al. |
| 2007/0095239 | A1 | 5/2007 | Skinner |
| 2011/0203475 | A1 | 8/2011 | Thuman |
| 2012/0227609 | A1 | 9/2012 | Volkmann |

FOREIGN PATENT DOCUMENTS

| | | | | |
|---|---|---|---|---|
| DE | 10 2014 004 003 | B3 | 10/2014 | |
| DE | EP 3012574 | A1 * | 4/2016 | ..... F42B 3/22 |

* cited by examiner

FIG. 3A
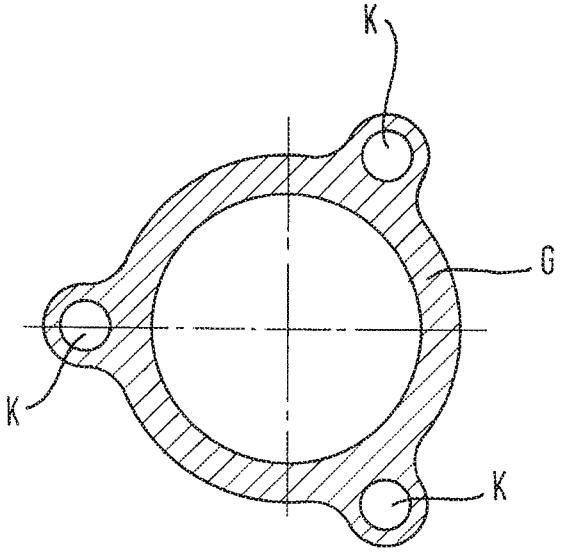
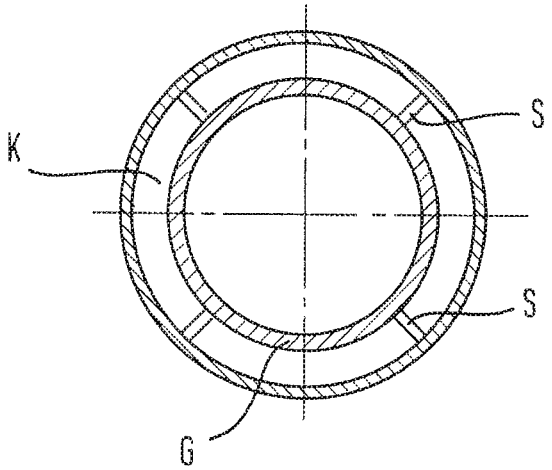
FIG. 3B

DEVICE FOR CONTROLLABLE PRESSURE RELIEF OF A WEAPON

CROSS REFERENCE TO RELATED APPLICATION

This application claims priority under 35 U.S.C. §119 from German Patent Application No. 10 2014 015 877.2, filed Oct. 24, 2014, the entire disclosure of which is herein expressly incorporated by reference.

BACKGROUND AND SUMMARY OF THE INVENTION

The invention relates to a device for controllable pressure relief of a weapon, comprising an explosive charge disposed in a casing, as well as a combined ignition device for deflagrative and detonative initiation of the explosive charge.

An important prerequisite in this regard, however, is that the deflagrative implementation proceeds in stable manner in terms of space and time. This results from the rates of energy dissipation in comparison with energy production, wherein different system parameters such as initiation, explosive charge properties, as well as insulation and ventilation of the explosive charge are decisive. For a specific ammunition system, a certain combination of these parameters therefore exists. One aspect of the present invention therefore is to concentrate on the required ventilation during deflagration, so that the latter can proceed in stable manner even in the case of complete insulation of the ammunition.

In the patent application DE 10 2014 004 003 B3, an ignition system is described, which allows adjustable power output of the weapon before the target is reached, in a broad range. For this purpose, the ratio between detonative and deflagrative implementation of the explosive charge is set to a desired value. This can take place by means of two ignition devices that are spaced far apart spatially, as is known from the state of the art. According to the disclosure, it is provided to dispose the two ignition devices directly next to one another. With regard to ventilation of the weapon, however, no indication of effective implementation is provided.

US 2011/0 203 475 A1 shows the aforementioned placement of two ignition locations with an ignition time point that can be selected independently for each. An air space is disposed around an inner explosive charge disposed along the central axis, which space in turn is surrounded by tubes composed of plastic or metal. In this way, the outer explosive charge can also be initiated deflagratively.

DE 10 2009 017 160 C2 relates to an ammunition having three ignition locations disposed on the central axis, which can be used to adjust not only the power of the ammunition but also the size of the fragments given off radially. One of the ignition locations brings about deflagration of the explosive charge.

In DE 100 08 914 C2, the fundamental principle of an ammunition having two ignition locations disposed on the central axis and acting in opposite directions became known. The power emitted detonatively can be adjusted within a very broad range by means of selecting the ignition time points.

One aspect of the invention is based on the task of indicating suitable ventilation for a weapon for the case of deflagrative implementation of the explosive charge, which ventilation prevents a destructive influence on the casing of the weapon.

This task is accomplished, according to the invention, in that the device for pressure relief can be triggered before or simultaneously with the initiation of the deflagrative reaction of the explosive charge, that the device for pressure relief is disposed in or directly adjacent to the ignition device, and that the means for pressure relief has at least one channel that can be opened in a controlled manner and connects the interior of the weapon with the external surroundings of the weapon.

Embodiments of the invention can be derived from the dependent claims.

Other objects, advantages and novel features of the present invention will become apparent from the following detailed description of one or more preferred embodiments when considered in conjunction with the accompanying drawings.

BRIEF DESCRIPTION OF THE DRAWINGS

FIG. 3A depicts one embodiment of the ventilation channel in a detonator housing having a round cross-section.

FIG. 3B depicts another embodiment of the ventilation channel in a detonator housing having a round cross-section.

DETAILED DESCRIPTION OF THE DRAWINGS

Figure 1:
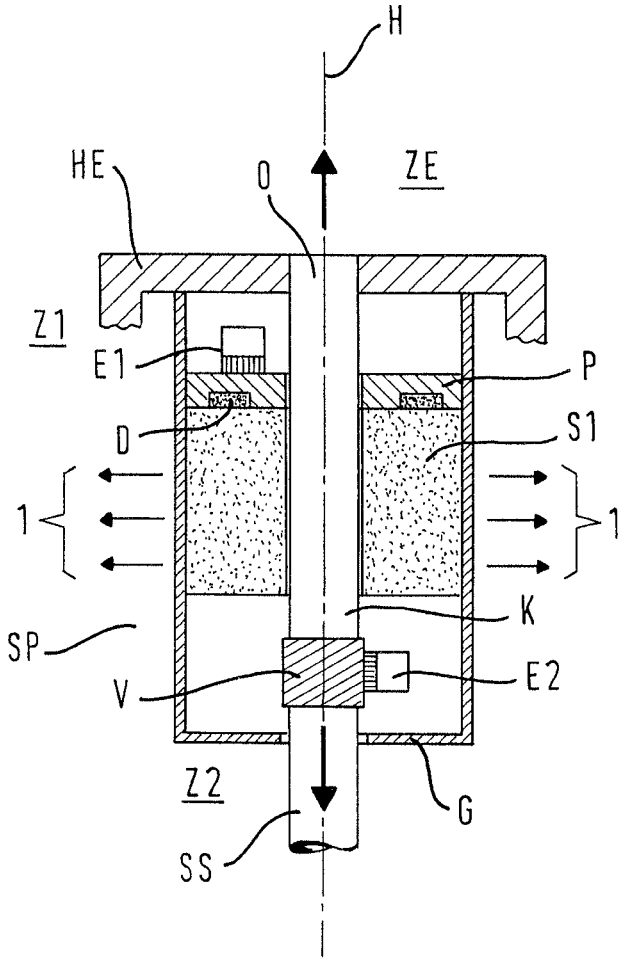
FIG. 1 depicts one embodiment of the invention with a central ventilation channel within the detonator housing.

In FIG. 1, a schematically simplified section through an ignition device ZE is shown, which device comprises both a first ignition location Z1 for detonative initiation and a further ignition location Z2 for deflagrative initiation of the explosive charge SP surrounding the ignition device ZE. The housing G of the ignition device ZE is connected with part of the casing HE of the weapon.

In an exemplary embodiment, the first ignition location Z1 is structured as a ring-shaped explosive charge S1. This charge is initiated in such a manner that its preferred direction of action 1 runs radially relative to the main axis H of the weapon, so that the most uniform initiation possible of the explosive charge SP in all radial directions can be achieved. For this purpose, a first EFI (Exploding Foil Initiator) E1, for example, is used as the primary detonator; it is mounted on a plate P that covers the ring-shaped explosive charge S1 on one side. In the plate P, ignition lines having the same length are provided, proceeding from the EFI E1; these lead to detonators D, which in turn lie against the ring-shaped explosive charge. For this purpose, at least two detonators D, disposed so that they are distributed uniformly on the surface of the ring-shaped explosive charge S1, are used.

The further ignition location Z2 for deflagrative initiation can also have a further EFI E2 as the primary detonator. This then acts, by way of an amplification charge V, on a charge that is structured as a detonating cord SS, or preferably as an adapted explosive charge core. The power output of the weapon can then be adjusted by means of the relative position of the ignition time points of the first and the further ignition location, by way of the ratio of detonatively implemented explosive to deflagratively implemented explosive.

In this exemplary embodiment, the means for pressure relief, according to the invention, is configured as a central tubular channel K that runs in the direction of the main axis H of the weapon. This channel begins directly at the further EFI E2 and leads all the way through the said part of the casing HE and the opening O to the outside. Therefore this channel K serves for direct pressure relief after ignition of the further EFI E2, wherein the opening O of the channel K is released. For another thing, the ring-shaped explosive charge S1 acts 1 not only on the explosive charge SP, but rather it also opens the channel K, thereby also making pressure relief toward the outside possible.

With regard to the required cross-sectional surface area of the channel K, it holds true empirically that amounts to at least 7 $mm^2$ and, with reference to the average cross-sectional surface area of the explosive charge SP, to at least 1/1000 thereof—without taking the thickness of the casing into account. This holds true, for example, for explosive charges having an inside diameter of 50 mm, wherein already in this case, a cross-sectional surface area of the channel of 1/50 of the cross-sectional surface area of the explosive charge is aimed at. Fundamentally, it holds true that the cross-sectional surface area of the pressure relief opening O increases in reduced proportion to the diameter of the explosive charge SP, the greater this diameter is selected to be.

Fundamentally, the pressure relief opening O should be disposed where deflagration begins and therefore the pressure first increases. This is more advantageous, in every case, than ventilation by way of a lid disposed in the casing of the weapon or by way of planned breaking points or openings in the casing. A pressure level within the explosive charge that maintains a stable deflagration reaction is achieved by means of timely and ongoing ventilation over the time of deflagration.

The time point of opening the pressure relief is decisive. This must take place in a timely manner before initiation of the deflagration, so that while deflagration is ramping up, an overly rapid pressure buildup is prevented. Furthermore, it is certainly helpful, already for reasons of redundancy, to provide a second pressure relief opening, wherein the sum of the cross-sections must reach the minimum cross-sectional surface area indicated.

Figure 2:
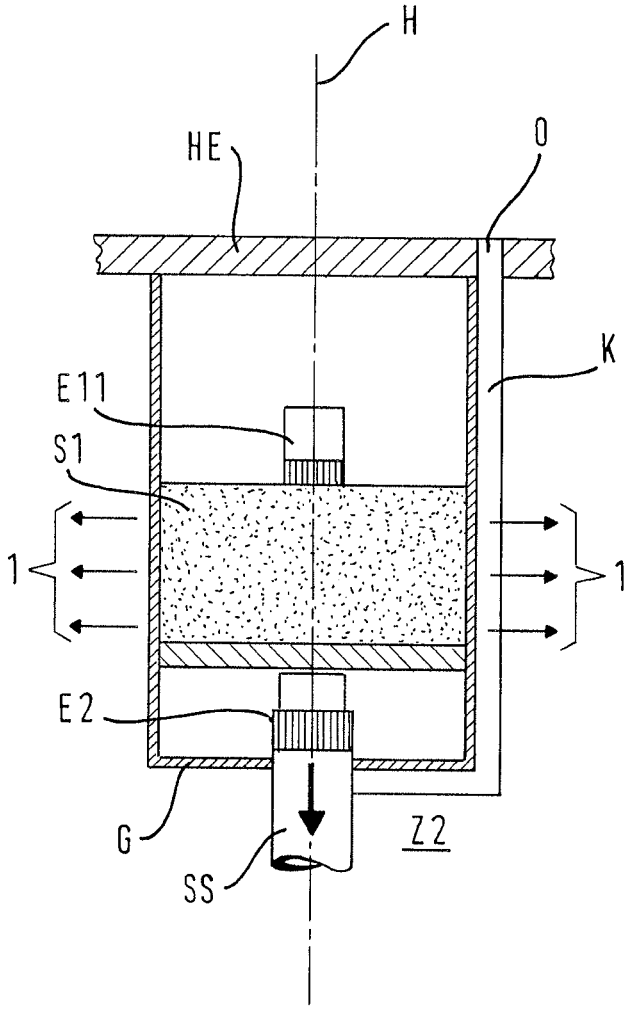
FIG. 2 depicts one embodiment of the invention having at least one ventilation channel disposed outside of the detonator housing.

In FIG. 2, an embodiment of the invention having at least one ventilation channel disposed outside of the detonator housing G is shown. The ignition locations Z1 and Z2 for deflagrative and detonative initiation of the explosive charge SP are disposed in the same manner as in the exemplary embodiment in FIG. 1, wherein because of the elimination of the central channel that runs in the direction of the main axis H of the weapon, the plate P with the ignition energy distribution is also eliminated, which plate covers the explosive charge S1 on one side. Instead, a central EFI E11 is provided on the main axis H. Initiation of the deflagrative implementation of the explosive charge SP takes place in the same manner as in the exemplary embodiment according to FIG. 1, by means of the EFI E2.

Here, pressure relief takes place by means of at least one ventilation channel K, which begins in the immediate vicinity of the ignition location Z2 for deflagrative initiation and leads to the outside along a short path, along the outside of the detonator housing G. Here, too, the aforementioned minimum cross-sectional surface area must be maintained.

The possible embodiments of the ventilation channel K can be adapted to the construction of the detonator housing. As an example, a version having three tubular channels K is shown in FIG. 3, and on the other hand, an embodiment having a channel K that runs circumferentially coaxially on the outside of the detonator housing G is shown, which channel is supported on the detonator housing G by means of crosspieces or struts S. This channel K, too, leads to the outside by way of openings O in the casing HE of the weapon. An apparatus for closing off the channel K against ambient influences can be provided, which apparatus is opened or removed at approximately the same time with initiation of the deflagrative implementation.

What is claimed is:

1. A device configured to control pressure relief of a weapon, the device comprising:
   - a detonator housing connectable with a casing of the weapon;
   - an explosive charge disposed in the detonator housing;
   - a combined ignition device having a first ignition location for detonative initiation and a second ignition location for deflagrative initiation of the explosive charge, wherein the device is configured to be triggered before or simultaneously with the initiation of the deflagrative reaction of the explosive charge; and
   - at least one channel disposed in or directly adjacent to the combined ignition device, wherein the at least one channel is configured to be opened in a controlled manner, and wherein the at least one channel connects an interior of the weapon, via the casing of the weapon, with external surroundings of the weapon such that pressure relief at the second ignition location is provided during deflagration.

2. The device according to claim 1, wherein the at least one channel has a minimum cross-section that depends on a diameter of the explosive charge, which minimum cross-section increases regressively with an increasing charge diameter and progressively with intensifying initiation.

3. The device according to claim 2, wherein a cross-sectional surface area of the at least one channel is at least 7 $mm^2$, and, as a function of the diameter of the explosive charge, is between 1/1000 and 1/50 of a cross-sectional surface area of the explosive charge.

4. The device according to at least one of claim 2, wherein the least one channel that can be opened using a drive.

5. The device according to claim 4, wherein a point in time at which the least one channel is opened is freely selectable between arming of the ignition device and deflagrative initiation.

6. The device according to at least one of claim 2, wherein the least one channel can be opened in the controlled manner as a function of reaching a selectable acceleration in a direction of a main axis of the weapon.

7. The device according to claim 1, wherein a cross-sectional surface area of the at least one channel is at least 7 $mm^2$, and, as a function of a diameter of the explosive charge, is between 1/1000 and 1/50 of a cross-sectional surface area of the explosive charge.

8. The device according to at least one of claim 7, wherein the least one channel that can be opened using a drive.

9. The device according to claim 8, wherein a point in time at which the least one channel is opened is freely selectable between arming of the ignition device and deflagrative initiation.

10. The device according to at least one of claim 7, wherein the least one channel can be opened in the controlled manner as a function of reaching a selectable acceleration in a direction of a main axis of the weapon.

11. The device according to claim 1, wherein the least one channel can be opened in the controlled manner as a function of time or can be permanently open at certain times.

12. The device according to at least one of claim 1, wherein the least one channel that can be opened using a drive.

13. The device according to claim 12, wherein a point in time at which the least one channel is opened is freely selectable between arming of the ignition device and deflagrative initiation.

14. The device according to at least one of claim 13, wherein the least one channel can be opened in the controlled manner as a function of reaching a selectable acceleration in a direction of a main axis of the weapon.

15. The device according to at least one of claim 12, wherein the least one channel can be opened in the controlled manner as a function of reaching a selectable acceleration in a direction of a main axis of the weapon.

16. The device according to at least one of claim 1, wherein the least one channel can be opened in the controlled manner as a function of reaching a selectable acceleration in a direction of a main axis of the weapon.

17. The device according to claim 1, wherein the least one channel can be opened in the controlled manner by at least one gas generator.

18. The device according to claim 1, wherein the at least one channel can be opened in the controlled manner using planned breaking points that have been worked in, at a previously-defined minimum pressure.

* * * * *